US007179768B2

(12) United States Patent
Uyttendaele et al.

(10) Patent No.: US 7,179,768 B2
(45) Date of Patent: Feb. 20, 2007

(54) TONING AGENTS FOR USE IN THERMOGRAPHIC RECORDING MATERIALS

(75) Inventors: Carlo Uyttendaele, Mortsel (BE); Johan Loccufier, Zwijnaarde (BE); Frank Louwet, Diepenbeek (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 11/257,480

(22) Filed: Oct. 24, 2005

(65) Prior Publication Data

US 2006/0100103 A1 May 11, 2006

Related U.S. Application Data

(60) Provisional application No. 60/625,508, filed on Nov. 5, 2004.

(51) Int. Cl.
*B41M 5/30* (2006.01)

(52) U.S. Cl. ..... 503/201; 503/209; 503/212

(58) Field of Classification Search ..... 503/200–276
See application file for complete search history.

(56) References Cited

U.S. PATENT DOCUMENTS

| | | | |
|---|---|---|---|
| 3,080,254 | A | 3/1963 | Grant |
| 3,885,967 | A | 5/1975 | Sashihara et al. |
| 3,926,976 | A | 12/1975 | Caluss et al. |
| 3,951,660 | A | 4/1976 | Hagemann et al. |
| 5,464,738 | A | 11/1995 | Lynch et al. |
| 5,496,695 | A | 3/1996 | Simpson et al. |
| 5,545,505 | A | 8/1996 | Simpson |
| 5,545,507 | A | 8/1996 | Simpson et al. |
| 5,545,515 | A | 8/1996 | Murray et al. |
| 5,558,983 | A | 9/1996 | Simpson et al. |
| 5,635,339 | A | 6/1997 | Murray |
| 5,654,130 | A | 8/1997 | Murray |

FOREIGN PATENT DOCUMENTS

| | | | | |
|---|---|---|---|---|
| EP | 0 622 217 | A1 | | 11/1994 |
| EP | 0 654 355 | A1 | | 5/1995 |
| EP | 0 692 733 | A2 | | 1/1996 |
| EP | 0 921 433 | | * | 6/1996 |
| EP | 0 736 799 | A1 | | 10/1996 |
| EP | 0 903 625 | A1 | | 3/1999 |
| EP | 0 964 300 | A1 | | 12/1999 |
| EP | 1 245 403 | A1 | | 10/2002 |
| EP | 1 245 404 | A1 | | 10/2002 |
| GB | 1 439 478 | A | | 6/1976 |
| JP | 59 025303 | A2 | | 2/1984 |
| JP | 60 214743 | A | | 10/1985 |

OTHER PUBLICATIONS

T.H. James; *The Theory of the Photographic Process*; Fourth Edition; p. 374 (1977).

T.H. James; *The Theory of the Photographic Process*; Fourth Edition; pp. 149-169 (1977).

* cited by examiner

*Primary Examiner*—Bruce H. Hess
(74) *Attorney, Agent, or Firm*—Leydig, Voit & Mayer, Ltd.

(57) ABSTRACT

A thermographic recording material comprising a support and a thermosensitive element, the thermosensitive element comprising at least one substantially light-insensitive organic silver salt, at least one organic reducing agent therefor in thermal working relationship therewith, at least one binder and at least one toning agent represented by formula (I):

(I)

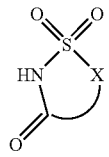

wherein X represents the optionally substituted atoms necessary to form a 6-membered ring.

26 Claims, No Drawings

TONING AGENTS FOR USE IN THERMOGRAPHIC RECORDING MATERIALS

CROSS-REFERENCE TO RELATED PATENT APPLICATIONS

This application claims the benefit of U.S. Provisional Application No. 60/625,508 filed Nov. 5, 2004, which is herein incorporated by reference.

FIELD OF THE INVENTION

The present invention concerns toning agents for use in thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 3,080,254 discloses a heat-sensitive chemically reactive copy-sheet suitable for the preparation from differentially radiation-absorptive graphic originals of thermographic reproductions having dark-colored image areas of pleasing appearance, said copy-sheet comprising a thin flexible carrier web-coated with a visibly heat-sensitive coating comprising (1) a film-forming binder, (2) a noble metal salt of an organic acid, and (3) a cyclic organic reducing agent for the noble metal ions, having an active hydrogen atom attached to an atom which is selected from the class of oxygen, nitrogen and carbon atoms and is directly attached to an atom of the cyclic ring, and additionally including (4) a significant small proportion, sufficient to cause observable darkening of the thermographic image, of a heterocyclic organic toning agent containing at least two hetero atoms in the heterocyclic ring, of which at least one is a nitrogen atom, such as phthalazinone, barbituric acid, 2-benzoxazolethiol and 1-acetyl-2-thiohydantoin.

Thermographic and photothermographic materials with prior art toning agents exhibit poor storage properties, as is the case with e.g. phthalazinone, and/or an image colour which has an insufficiently neutral tone for black and white images, as is the case with e.g. succinimide, phthalimide, phthalic acid and phthalazine. The use of 3,4-dihydro-2,4-dioxo-1,3,2H-benzoxazine as a toning agent in thermographic materials, as disclosed in U.S. Pat. No. 3,951,660, represented an improvement in the neutrality of the image tone, whether substituted, as disclosed in U.S. Pat. No. 3,885,967 and U.S. Pat. No. 3,951,660, or unsubstituted, as disclosed in U.S. Pat. No. 3,951,660. However, such toning agents are insufficiently soluble in ecologically acceptable coating solvents and diffuse through the thermographic materials to the thermal head resulting in cloudiness in the imaging material, deposits on the surface of the thermographic material and, in the case of substantially light-insensitive thermographic materials in thermal head printers, image degradation due to thermal head contamination. There is therefore a need for alternative toning agents in thermographic materials, which do not have an adverse effect on the image tone.

ASPECTS OF THE INVENTION

It is therefore an aspect of the present invention to provide toning agents for use in substantially light-insensitive thermographic recording materials suitable for use in thermographic printers without adverse effect on the image tone.

It is therefore an aspect of the present invention to provide toning agents for use in photothermographic materials suitable for use in photothermographic printers without adverse effect on the image tone.

Further aspects and advantages of the invention will become apparent from the description hereinafter.

SUMMARY OF THE INVENTION

U.S. Pat. No. 3,080,254 further discloses that saccharin:

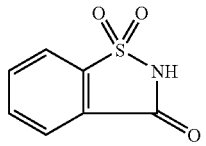

5-nitrosaccharin, 2-hydroxybenzo-thiazole, imidazole, 2-amino-6-methylbenzothiazole, 2-amino-4-(4-biphenylyl)-thiazole and N,N'-ethylenethiourea are somewhat less effective toning agents than phthalazinone, barbituric acid, 2-benzoxazolethiol and 1-acetyl-2-thiohydantoin. The inventors have confirmed the finding in U.S. Pat. No. 3,080,254 that saccharin, a compound according to formula (I):

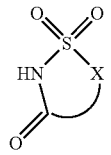

(I)

in which X represents the substituted atoms necessary to form a 5-membered ring, is an inferior toning agent to phthalazinone. Surprisingly, it has been found that compounds according to formula (I) in which X represents the optionally substituted atoms necessary to form a 6-membered ring exhibit superior toning properties to saccharin, such toning properties being comparable or better than those exhibited by phthalazinone. In addition it was found that such compounds exhibit sufficient solubility in ecologically acceptable coating solvents.

Aspects of the present invention are realized with a thermographic recording material comprising a support and a thermosensitive element, the thermosensitive element comprising at least one substantially light-insensitive organic silver salt, at least one organic reducing agent therefor in thermal working relationship therewith, at least one binder and at least one toning agent represented by formula (I):

(I)

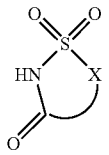

wherein X represents the optionally substituted atoms necessary to form a 6-membered ring.

Aspects of the present invention are also realized by a process using compounds according to the above-mentioned formula (I) as toning agents in imaging processes involving the formation of silver particles comprising the steps of: providing a thermographic recording material; imagewise heating or imagewise exposure followed by uniform heating of the imagewise exposed thermographic recording material.

Preferred embodiments of the present invention are disclosed in the detailed description of the invention.

DETAILED DESCRIPTION OF THE INVENTION

Definitions

The term thermographic material as used in disclosing the present invention includes both photothermographic materials and substantially light-insensitive thermographic materials.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The term alicyclic ring system, as used in disclosing the present invention, means a ring system consisting exclusively of carbon atoms, which is not aromatic.

The term heterocyclic ring system, as used in disclosing the present invention, means a ring system consisting of carbon and other atoms, which is not heteroaromatic.

The term carbocyclic ring, as used in disclosing the present invention, includes both alicylic rings and aromatic rings.

Substantially light-insensitive means not intentionally light sensitive.

The L*, a* and b* CIELAB-values are defined in ASTM Norm E179-90 in a R(45/0) geometry with evaluation according to ASTM Norm E308-90 and have been used to characterize the image tone of thermographic materials of the present invention.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermographic Recording Material

Aspects of the present invention are realized with a thermographic recording material comprising a support and a thermosensitive element, the thermosensitive element comprising at least one substantially light-insensitive organic silver salt, at least one organic reducing agent therefor in thermal working relationship therewith, at least one binder and at least one toning agent represented by formula (I):

(I)

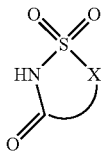

wherein X represents the optionally substituted atoms necessary to form a 6-membered ring.

According to a first embodiment of the thermographic recording material, according to the present invention, the thermographic recording material is a black and white thermographic recording material.

According to a second embodiment of the thermographic recording material, according to the present invention, the thermographic recording material is a monosheet thermographic recording material.

Thermosensitive Element

The term thermosensitive element as used herein is that element which comprises all the ingredients which contribute to image formation. According to the present invention, the thermosensitive element comprises one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

Compounds Represented by Formula (I)

Aspects of the present invention are realized with a thermographic recording material comprising a support and a thermosensitive element, the thermosensitive element comprising at least one substantially light-insensitive organic silver salt, at least one organic reducing agent therefor in thermal working relationship therewith, at least one binder and at least one toning agent represented by formula (I):

(I)

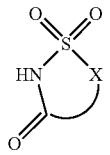

wherein X represents the optionally substituted atoms necessary to form a 6-membered ring.

According to a third embodiment of the thermographic material, according to the present invention, the at least one toning agent represented by formula (I) is a substituted or unsubstituted 3,4-dihydro-1,2,3-oxathiaz-4-one 2,2-dioxide.

According to a fourth embodiment of the thermographic material, according to the present invention, X represents a —O—$R^1$C═C$R^2$— group with the oxygen atom directly bonded to the sulphur atom of the sulphonyl group and $R^1$ and $R^2$ are independently hydrogen, halogen or an optionally substituted alkyl (e.g. methyl, ethyl, n-propyl, isopropyl, n-butyl, sec.-butyl, isobutyl, tert. butyl, n-octyl) aryl, alkoxy, aryloxy, acyl or nitrile group; or $R^1$ and $R^2$ together represent the atoms necessary to form a alicyclic, aryl, heterocyclic or heteroaromatic ring system.

According to a fifth embodiment of the thermographic recording material, according to the present invention, X is

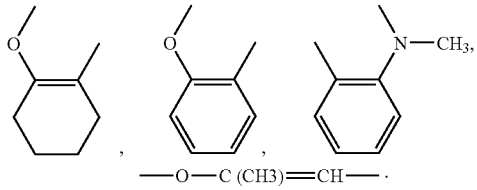

According to an sixth embodiment of the thermographic recording material, according to the present invention, the at least one toning agent represented by formula (I) is selected from the group consisting of

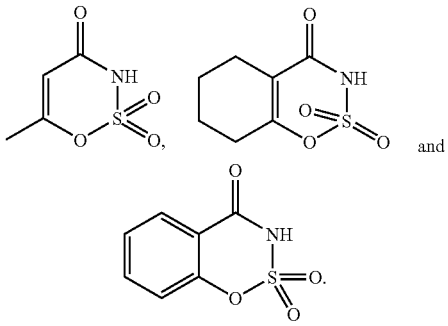

Compounds according to formula (I) can be prepared from readily available starting materials using standard organic chemistry techniques known to one skilled in the art and available in such reference books as Houben-Weyl, herein incorporated by reference, and specifically according to the syntheses disclosed in JP 59-025303A, JP 60-214743A and U.S. Pat. No. 3,926,976, which are all herein incorporated by reference.

Suitable compounds according to formula (I), according to the present invention, include:

| toning agent nr. | | Melting point (° C.) | Solubility in methyl ethyl ketone [wt %] |
|---|---|---|---|
| TA01 | 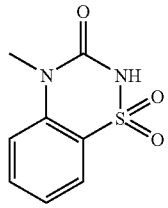 | | >2 |
| TA02 | 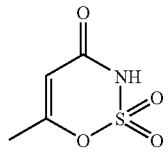 6-methyl-3,4-dihydro-1,2,3-oxathiaz-4-one 2,2-dioxide | 123–124 | >10 |
| TA03 | 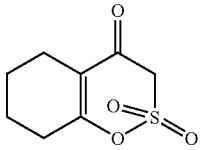 | 122–123 | 5.5 |
| TA04 | 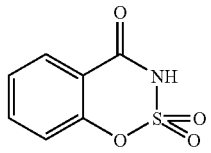 4-oxo-3,4-dihydro-1,2,3-benzoxathiazine 2,2-dioxide | 170–171 | >10 |
| TA05 | 3,4-dihydro-1,2,3-oxathiaz-4-one 2,2-dioxide | 106–107 | |
| TA06 | 5,6-dibenzo-3,4-dihydro-1,2,3 oxathiaz-4-one 2,2-dioxide | 170–171 | |
| TA07 | 5-methyl-3,4-dihydro-1,2,3-oxathiaz-4-one 2,2-dioxide | 107–108 | |
| TA08 | 5,6-dimethyl-3,4-dihydro-1,2,3-oxathiaz-4-one 2,2-dioxide | 108–109 | |
| TA09 | 5-ethyl-6-methyl-3,4-dihydro-1,2,3-oxathiaz-4-one 2,2-dioxide | 101–102 | |
| TA10 | 5-isopropyl-6-methyl-3,4-dihydro-1,2,3-oxathiaz-4-one 2,2-dioxide | 113–114 | |
| TA11 | 5-n-butyl-6-methyl-3,4-dihydro-1,2,3-oxathiaz-4-one 2,2-dioxide | 96–97 | |
| TA12 | 5-n-octyl-6-methyl-3,4-dihydro-1,2,3-oxathiaz-4-one 2,2-dioxide | 57–58 | |
| TA13 | 5-benzo-6-methyl-3,4-dihydro-1,2,3-oxathiaz-4-one 2,2-dioxide | 144–145 | |
| TA14 | 6-ethyl-5-methyl-3,4-dihydro-1,2,3-oxathiaz-4-one 2,2-dioxide | 93–94 | |
| TA15 | 5-ethyl-6-n-propyl-3,4-dihydro-1,2,3-oxathiaz-4-one 2,2-dioxide | 85–86 | |
| TA16 | 5-ethyl-3,4-dihydro-1,2,3-oxathiaz-4-one 2,2-dioxide | 73 | |
| TA17 | 6-n-butyl-3,4-dihydro-1,2,3-oxathiaz-4-one 2,2-dioxide | 62–63 | |
| TA18 | 6-n-butyl-5-n-propyl-3,4-dihydro-1,2,3-oxathiaz-4-one 2,2-dioxide | 46–47 | |
| TA19 | 5-n-butyl-6-n-pentyl-3,4-dihydro-1,2,3-oxathiaz-4-one 2,2-dioxide | 34–35 | |
| TA20 | 6-benzo-3,4-dihydro-1,2,3-oxathiaz-4-one 2,2-dioxide | 180–181 | |

-continued

| toning agent nr. | | Melting point (° C.) | Solubility in methyl ethyl ketone [wt %] |
|---|---|---|---|
| TA21 | 6-benzo-5-methyl-3,4-dihydro-1,2,3-oxathiaz-4-one 2,2-dioxide | 122–123 | |
| TA22 | 5-acetyl-6-benzo-3,4-dihydro-1,2,3-oxathiaz-4-one 2,2-dioxide | 164 | |

Substantially Light-insensitive Organic Silver Salt

According to a seventh embodiment of the thermographic recording material of the present invention, the substantially light-insensitive organic silver salts are not double organic salts comprising a silver cation associated with a second cation e.g. magnesium or iron ions.

According to an eighth embodiment of the thermographic recording material of the present invention, at least one of the substantially light-insensitive organic silver salts is a substantially light-insensitive silver salt of an organic carboxylic acid.

According to a ninth embodiment of the thermographic recording material of the present invention, at least one of the substantially light-insensitive organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to a tenth embodiment of the thermographic recording material, according to the present invention, the at least one reducing agent is an organic compound comprising at least one active hydrogen atom linked to O, N or C, such as is the case with, aromatic di- and tri-hydroxy compounds. 1,2-dihydroxy-benzene derivatives, such as catechol, 3-(3,4-dihydroxyphenyl) propionic acid, 1,2-dihydroxybenzoic acid, gallic acid and esters e.g. methyl gallate, ethyl gallate, propyl gallate and 3,4-dihydroxy-benzoic acid esters are preferred, with those described in EP-A 0 692 733, EP-A 0 903 625, EP-A 1 245 403 and EP-A 1 245 404 herein incorporated by reference being particularly preferred e.g. ethyl 3,4-dihydroxybenzoate, n-butyl 3,4-dihydroxybenzoate, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The at least one film-forming binder of the thermosensitive element may be all kinds of natural, modified natural or synthetic resins or mixtures of such resins, in which the at least one light-insensitive organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

According to an eleventh embodiment of the thermographic recording material, according to the present invention, the at least one binder is a copolymer of vinyl acetoacetal, vinyl butyral, vinyl alcohol and vinyl acetate.

The binder to organic silver salt weight ratio is preferably in the range of 0.2 to 7, and the thickness of the thermosensitive element is preferably in the range of 5 to 50 μm. Binders are preferred which do not comprise additives, such as certain antioxidants (e.g. 2,6-di-tert-butyl-4-methylphenol), or impurities which adversely affect the thermographic properties of the thermographic recording materials in which they are used.

Stabilizers

According to an twelfth embodiment of the thermographic recording material, according to the present invention, the thermosensitive element further comprises a stabilizer.

According to a thirteenth embodiment of the thermographic recording material, according to the present invention, the thermosensitive element further comprises a stabilizer selected from the group consisting of benzotriazole; substituted benzotriazoles; aromatic polycarboxylic acid, such as ortho-phthalic acid, 3-nitro-phthalic acid, tetrachlorophthalic acid, mellitic acid, pyromellitic acid and trimellitic acid and anhydrides thereof; 1-phenyl-5-mercapto-tetrazole compounds in which the phenyl group is substituted with a substituent comprising an optionally substituted aryl group, 1-(5-mercapto-1-tetrazolyl)-acetyl compounds represented by formula (II):

(II)

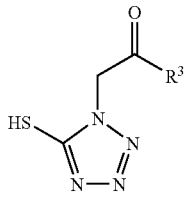

wherein $R^3$ is —$NR^4R^5$, —$OR^6$ or an optionally substituted aryl or heteroaryl group; $R^4$ is hydrogen or an optionally substituted alkyl, aryl or heteroaryl group; $R^5$ is an optionally substituted aryl or heteroaryl group; and $R^6$is an optionally substituted aryl group; and compounds with two or more groups represented by formula (III):

(III)

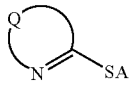

where Q comprises the necessary atoms to form a 5- or 6-membered unsaturated heterocyclic ring, A is hydrogen, a counterion to compensate the negative charge of the thiolate group or two or more A groups provide a linking group between the two or more groups represented by formula (III).

According to a fourteenth embodiment of the thermographic recording material, according to the present invention, the thermosensitive element further comprises at least one optionally substituted aliphatic or carbocyclic polycarboxylic acid and/or anhydride thereof in a molar percentage of at least 15 with respect to all the organic silver salt(s) present and in thermal working relationship therewith. The polycarboxylic acid may be used in anhydride form or partially esterified on the condition that at least two free carboxylic acids remain or are available during the heat recording step.

Photosensitive Silver Halide

According to a fifteenth embodiment of the thermographic material, according to the present invention, the thermosensitive element further comprises photosensitive silver halide, thereby rendering the thermographic material photothermographic.

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be chemically sensitized with a chemical sensitising merocyanine dye containing a thione group, and optionally with a chemical sensitizing agent such as a compound containing sulphur, selenium, tellurium etc., or a compound containing gold, platinum, palladium, iron, ruthenium, rhodium or iridium etc. in addition to sensitization with specific reducing agents, according to the present invention. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in which the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

Surfactants and Dispersants

Surfactants and dispersants aid the dispersion of ingredients which are insoluble in the particular dispersion medium. The substantially light-insensitive thermographic material used in the present invention may comprise one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a sixteenth embodiment of the thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated thermosensitive element. The support may be dyed or pigmented to provide a transparent coloured background for the image.

Protective Layer

According to a seventeenth embodiment of the thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Process

According to a first embodiment of the process, according to the present invention, X represents a —O—$R^1C{=}CR^2$— group with the oxygen atom directly bonded to the sulphur atom of the sulphonyl group and $R^1$ and $R^2$ are independently hydrogen, halogen or an optionally substituted alkyl, aryl, alkoxy, aryloxy, acyl or nitrile group; or $R^1$ and $R^2$ together represent the atoms necessary to form a alicyclic, aryl, heterocyclic or heteroaromatic ring system.

Processing of Substantially Light-insensitive Thermographic Materials

Imaging with substantially light-insensitive thermographic materials is carried out by the image-wise application of heat either in analogue fashion by direct exposure through an image or by reflection from an image, or in digital fashion pixel by pixel either by using an infra-red heat source, for example with a Nd-YAG laser or other infra-red laser, with the substantially light-insensitive thermographic material preferably comprising an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Photothermographic Printing

Appropriately spectrally sensitized photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a Violet-laser, a He/Ne-laser or an IR-laser diode, e.g. emitting at 400 nm, 630 nm, 650 nm, 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

EXAMPLES

Subbing layer Nr. 01 on the emulsion side of the support had the composition:

| | |
|---|---|
| copolymer of 88% vinylidene chloride, 10% methyl acrylate and 2% itaconic acid | 151 mg/m$^2$ |
| Kieselsol ® 100F, a colloidal silica from BAYER | 35 mg/m$^2$ |
| Mersolat ® H, a surfactant from BAYER | 0.8 mg/m$^2$ |

Ingredients in the thermosensitive element in addition to the above-mentioned ingredients:

BL5HP=S-LEC BL5HP, a polyvinyl butyral from SEKISUI;

COPOLYMER=copolymer with 44 wt % vinyl aceto-acetal, 29 wt % vinyl 01 butyral, 11 wt % vinyl alcohol and 2 wt % vinyl acetate as determined from $^{13}$C NMR measurements which in a 30 wt % solution in methyl ethyl ketone exhibited a viscosity of 3.4 Pa·s at a shear rate of 10 s$^{-1}$ and a temperature of 25° C.

Oil=BAYSILON, a silicone oil from BAYER;

VL=DESMODUR VL, a 4,4'-diisocyanatodiphenylmethane from BAYER;

Reducing Agents:

R01=3,4-dihydroxybenzonitrile;

R02=3,4-dihydroxybenzophenone;

Stabilizers:

S01=glutaric acid

S02=tetrachlorophthalic acid anhydride

S03=benzotriazole

Further Compounds in Comparative Examples

CPD01 =

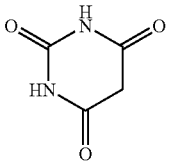

barbituric acid cited as toning agent in U.S. Pat. No. 3,080,254

CPD02 =

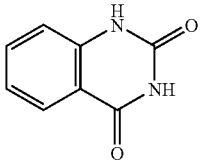

quinazolidine-2,4-dione

CPD03 =

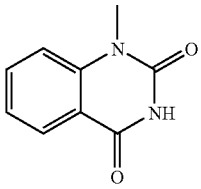

1-N-methyl-quinazolidine-2,4-dione

CPD04 =

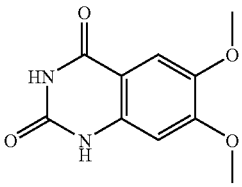

6,7-dimethoxy-quinazolidine-2,4-dione

CPD05 =

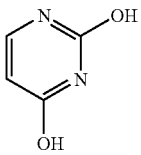

2,4-dihydroxy-pyrimidine

-continued

CPD06 =

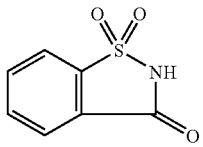

saccharin cited as toning agent in U.S. Pat. No. 3,080,254

CPD07 =

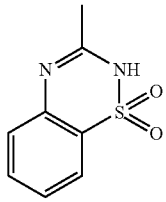

CPD08 =

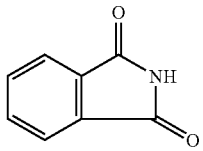

phthalimide

CPD09 =

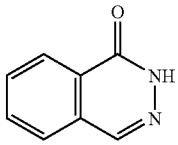

phthalazinone cited as toning agent in U.S. Pat. No. 3,080,254

CPD10 =

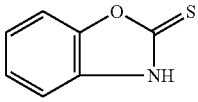

2-benzoxazonethiol cited as toning agent in U.S. Pat. No. 3,080,254

Reference Examples 1 to 3 and Comparative Example 1

The substantially light-insensitive thermographic materials of REFERENCE EXAMPLES 1 to 3 and COMPARATIVE EXAMPLE 1 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 85° C. for 3 minutes in a drying cupboard with the compositions given in Table 1 below.

TABLE 1

| | toning agent | | AgBeh | | R02 | S01 | S02 | S03 | | |
|---|---|---|---|---|---|---|---|---|---|---|
| | type | mol % vs AgB | coverage [g/m$^2$] | COPOLYMER 01 [g/m$^2$] | mol % vs AgB | mol % vs AgB | mol % vs AgB | mol % vs AgB | VL [g/m$^2$] | Oil [g/m$^2$] |
| Reference example nr. | | | | | | | | | | |
| 1 | — | — | 3.73 | 13.45 | 45 | 24 | 5 | 3 | 0.175 | 0.033 |
| 2 | CPD06 | 15 | 3.73 | 13.45 | 45 | 24 | 5 | 3 | 0.175 | 0.033 |
| 3 | CPD09 | 15 | 3.73 | 13.45 | 45 | 24 | 5 | 3 | 0.175 | 0.033 |
| Comparative example nr. | | | | | | | | | | |
| 1 | CPD08 | 15 | 3.73 | 13.45 | 45 | 24 | 5 | 3 | 0.175 | 0.033 |

Thermographic Printing

The substantially light-insensitive thermographic recording materials of REFERENCE EXAMPLES 1 to 3 and COMPARATIVE EXAMPLE 1 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities. During printing the print head was separated from the imaging layer by a thin intermediate material contacted with a slipping layer of a separable 5 μm thick polyethylene terephthalate ribbon coated successively with a subbing layer, heat-resistant layer and said slipping layer (anti-friction layer) giving the ribbon with a total thickness of 6 μm.

Evaluation of Thermographic Properties

The image tone of fresh prints made with the substantially light-insensitive thermographic recording materials of REFERENCE EXAMPLES 1 to 3 and COMPARATIVE EXAMPLE 1 was assessed on the basis of the L*, a* and b* CIELAB-values at optical densities, D, of 1.0 and 2.0 and the results given in Table 2.

The results in Table 2 confirm the finding in U.S. Pat. No. 3,080,254 that saccharin (CPD06) and phthalazinone (CPD09) are both toning agents in the thermosensitive element of thermographic recording materials with a copolymer of vinyl aceto-acetal, vinyl butyral, vinyl alcohol and vinyl acetate as binder, i.e. render the CIELAB a* and b* values more neutral or even slightly blue (negative b* values) relative to a the CIELAB a* and b* values of a thermographic recording material without a toning agent. Moreover, these results also confirm the finding in U.S. Pat. No. 3,080,254 that phthalzinone (CPD09) has a much stronger toning effect in the thermosensitive element of thermographic recording materials than saccharin (CPD06) in that it renders the image more blue i.e. renders the b* value for D=1.0, for which the human eye is much more sensitive, more negative.

Furthermore, these results show that phthalimide (CPD08) exhibits toning properties in the thermosensitive element of thermographic recording materials, but that these are inferior to those of saccharin (CPD06) and far inferior to those of phthalazinone (CPD09) in the thermosensitive element of thermographic recording materials.

Comparative Examples 2 to 5

The substantially light-insensitive thermographic materials of COMPARATIVE EXAMPLES 2 to 5 were prepared as described for REFERENCE EXAMPLES 1 to 3 and COMPARATIVE EXAMPLE 1, but with the compositions given in Table 3 below.

TABLE 2

| | | | Fresh prints | | | | | |
|---|---|---|---|---|---|---|---|---|
| | Toning agent | | | | CIELAB-values | | | |
| | | | | | At D = 1.0 | | At D = 2.0 | |
| | type | conc. [mol %] | Dmin vis | Dmax vis | a* | b* | a* | b* |
| Reference example nr | | | | | | | | |
| 1 | — | — | 0.21 | 3.27 | +22.01 | +19.78 | +23.71 | +6.57 |
| 2 | CPD06 | 15 | 0.22 | 3.13 | +16.30 | +3.43 | +15.04 | −5.95 |
| 3 | CPD09 | 15 | 0.22 | 3.52 | +16.20 | −3.41 | +19.28 | −4.14 |
| Comparative example nr | | | | | | | | |
| 1 | CPD08 | 15 | 0.22 | 3.49 | +18.16 | +3.47 | +19.48 | −0.10 |

TABLE 3

| Comparative example nr. | toning agent type | toning agent mol % vs AgB | AgBeh coverage [g/m²] | COPOLYMER 01 [g/m²] | R01 mol % vs AgB | R02 mol % vs AgB | S01 mol % vs AgB | S02 mol % vs AgB | S03 mol % vs AgB | VL [g/m²] | Oil [g/m²] |
|---|---|---|---|---|---|---|---|---|---|---|---|
| 2 | — | | 3.73 | 13.45 | 0 | 45 | 24 | 5 | 3 | 0.175 | 0.033 |
| 3 | CPD02 | 15 | 3.73 | 13.45 | 0 | 45 | 24 | 5 | 3 | 0.175 | 0.033 |
| 4 | CPD04 | 15 | 3.73 | 13.45 | 0 | 45 | 24 | 5 | 3 | 0.175 | 0.033 |
| 5 | CPD05 | 15 | 3.73 | 13.45 | 0 | 45 | 24 | 5 | 3 | 0.175 | 0.033 |

The thermographic recording materials of COMPARATIVE EXAMPLES 2 to 5 were printed and the prints evaluated as described for REFERENCE EXAMPLES 1 to 3 and COMPARATIVE EXAMPLE 1. The results are given in Table 4.

TABLE 4

| Comparative Example nr | Toning agent type | Toning agent conc. [mol % vs AgB] | Fresh prints Dmin vis | Fresh prints Dmax vis | CIELAB-values At D = 1.0 a* | At D = 1.0 b* | At D = 2.0 a* | At D = 2.0 b* |
|---|---|---|---|---|---|---|---|---|
| 2 | — | | 0.22 | 3.60 | +20.99 | +17.93 | +22.26 | +4.42 |
| 3 | CPD02 | 15 | 0.22 | 3.07 | +16.98 | +8.05 | +17.10 | −1.03 |
| 4 | CPD04 | 15 | 0.22 | 3.21 | +23.20 | +15.73 | +23.39 | +3.89 |
| 5 | CPD05 | 15 | 0.22 | 3.39 | +19.70 | +13.83 | +20.66 | −0.22 |

Considering the results of Table 2 and Table 4 together, which is permissible in view of the identical compositions of the thermographic recording materials other than the "toning agent" and the similar a* and b* CIELAB-values at D=1.0 and D=2.0 for REFERENCE EXAMPLE 1 and COMPARATIVE EXAMPLE 2, we find that 6,7-dimethoxyquinazolidine-2,4-dione (CPD04) exhibits no toning properties in the thermosensitive element of thermographic recording materials with a copolymer of vinyl aceto-acetal, vinyl butyral, vinyl alcohol and vinyl acetate as binder and that quinazolidine-2,4-dione (CPD02) and 2,4-dihydroxypyrimidine (CPD05) exhibit toning properties in the thermosensitive element of thermographic recording materials with a copolymer of vinyl aceto-acetal, vinyl butyral, vinyl alcohol and vinyl acetate as binder which are inferior to those of saccharin (CPD06) and far inferior to those of phthalazinone (CPD09).

Comparative Examples 6 to 8

The substantially light-insensitive thermographic materials of COMPARATIVE EXAMPLES 6 to 8 were prepared as described for REFERENCE EXAMPLES 1 to 3 and COMPARATIVE EXAMPLE 1, but with the compositions given in Table 5 below.

TABLE 5

| Comparative example nr. | toning agent of present invention type | toning agent of present invention mol % vs AgB | AgBeh coverage [g/m²] | COPOLYMER 01 [g/m²] | R01 mol % vs AgB | R02 mol % vs AgB | S01 mol % vs AgB | S02 mol % vs AgB | S03 mol % vs AgB | VL [g/m²] | Oil [g/m²] |
|---|---|---|---|---|---|---|---|---|---|---|---|
| 6 | — | | 3.73 | 13.45 | 0 | 45 | 24 | 5 | 3 | 0.175 | 0.033 |
| 7 | CPD02 | 15 | 3.73 | 13.45 | 0 | 45 | 24 | 5 | 3 | 0.175 | 0.033 |
| 8 | CPD03 | 15 | 3.73 | 13.45 | 0 | 45 | 24 | 5 | 3 | 0.175 | 0.033 |

The thermographic recording materials of COMPARATIVE EXAMPLES 6 to 8 were printed and the prints evaluated as described for REFERENCE EXAMPLES 1 to 3 and COMPARATIVE EXAMPLE 1. The results are given in Table 6.

TABLE 6

| Comparative Example nr | Toning agent type | Toning agent conc. [mol % vs AgB] | Fresh prints Dmin vis | Fresh prints Dmax vis | CIELAB-values At D = 1.0 a* | CIELAB-values At D = 1.0 b* | CIELAB-values At D = 2.0 a* | CIELAB-values At D = 2.0 b* |
|---|---|---|---|---|---|---|---|---|
| 6 | — | | 0.21 | 3.34 | +20.13 | +14.47 | +20.17 | +3.98 |
| 7 | CPD02 | 15 | 0.21 | 3.19 | +21.17 | +8.51 | +15.48 | +2.41 |
| 8 | CPD03 | 15 | 0.21 | 3.27 | +20.07 | +8.48 | +19.50 | +6.13 |

Considering the results of Table 2 and Table 6 together, which is permissible in view of the identical compositions of the thermographic recording materials other than the "toning agent" and the similar a* and b* CIELAB-values at D=1.0 and D=2.0 for REFERENCE EXAMPLE 1 and COMPARATIVE EXAMPLE 6, we find that 1-N-methyl-quinazolidine-2,4-dione (CPD03) exhibits little toning activity in the thermosensitive element of thermographic recording materials with a copolymer of vinyl aceto-acetal, vinyl butyral, vinyl alcohol and vinyl acetate as binder and that quinazolidine-2,4-dione (CPD02) exhibits toning properties in the thermosensitive element of thermographic recording materials with a copolymer of vinyl aceto-acetal, vinyl butyral, vinyl alcohol and vinyl acetate as binder which are inferior to those of saccharin (CPD06) and far

Comparative Examples 9 and 10 and Invention Example 1

The substantially light-insensitive thermographic materials of COMPARATIVE EXAMPLES 9 and 10 and INVENTION EXAMPLE 1 were prepared as described for REFERENCE EXAMPLES 1 to 3 and COMPARATIVE EXAMPLE 1, but with the compositions given in Table 7 below.

TABLE 7

| | toning agent type | toning agent mol % vs AgB | AgBeh coverage [g/m$^2$] | COPOLYMER 01 [g/m$^2$] | R01 mol % vs AgB | R02 mol % vs AgB | S01 mol % vs AgB | S02 mol % vs AgB | S03 mol % vs AgB | VL [g/m$^2$] | Oil [g/m$^2$] |
|---|---|---|---|---|---|---|---|---|---|---|---|
| Comparative example nr. | | | | | | | | | | | |
| 9 | — | | 3.73 | 13.45 | 0 | 45 | 24 | 5 | 3 | 0.175 | 0.033 |
| 10 | CPD07 | 15 | 3.73 | 13.45 | 0 | 45 | 24 | 5 | 3 | 0.175 | 0.033 |
| Invention example nr. | | | | | | | | | | | |
| 1 | TA02 | 15 | 3.73 | 13.45 | 0 | 45 | 24 | 5 | 3 | 0.175 | 0.033 |

The thermographic recording materials of COMPARATIVE EXAMPLES 9 and 10 and INVENTION EXAMPLE 1 were printed and the prints evaluated as described for REFERENCE EXAMPLES 1 to 3 and COMPARATIVE EXAMPLE 1. The results are given in Table 8.

TABLE 8

| | Toning agent type | Toning agent conc. [mol % vs AgB] | Fresh prints Dmin vis | Fresh prints Dmax vis | CIELAB-values At D = 1.0 a* | CIELAB-values At D = 1.0 b* | CIELAB-values At D = 2.0 a* | CIELAB-values At D = 2.0 b* |
|---|---|---|---|---|---|---|---|---|
| Comparative Example nr | | | | | | | | |
| 9 | — | — | 0.20 | 3.30 | 29.3 | 25.6 | 24.6 | 12.3 |
| 10 | CPD07 | 15 | 0.21 | 3.13 | 24.5 | 15.5 | 23.1 | 9.9 |
| Invention Example nr | | | | | | | | |
| 1 | TA02 | 15 | 0.21 | 3.10 | 10.9 | −7.9 | 6.3 | −2.6 |

The results in Table 8 show that TA02, a toning agent according to the present invention, exhibits strong toning properties in the thermosensitive element of thermographic recording materials with a copolymer of vinyl aceto-acetal, vinyl butyral, vinyl alcohol and vinyl acetate as binder i.e. much more neutral a* CIELAB-values for D=1.0 and D=2.0 and much more blue i.e. negative b* CIELAB-values for D=1.0 and D=2.0, whereas CPD07, a compound according to formula (I) with X represented by a substituted —C═C—N═C($CH_3$)— group exhibited very weak toning properties in the thermosensitive element of thermographic recording materials with a copolymer of vinyl aceto-acetal, vinyl butyral, vinyl alcohol and vinyl acetate as binder.

Comparative Example 11
and
Invention Examples 2 to 4

The substantially light-insensitive thermographic materials of COMPARATIVE EXAMPLE 11 and INVENTION EXAMPLES 2 to 4 were prepared as described for REFERENCE EXAMPLES 1 to 3 and COMPARATIVE EXAMPLE 1, but with the compositions given in Table 9 below in which the compositions for REFERENCE EXAMPLES 1 and 2 are also included.

TABLE 9

| | toning agent | | AgBeh | | R02 | S01 | S02 | S03 | | |
|---|---|---|---|---|---|---|---|---|---|---|
| | type | mol % vs AgB | coverage [g/m$^2$] | COPOLYMER 01 [g/m$^2$] | mol % vs AgB | mol % vs AgB | mol % vs AgB | mol % vs AgB | VL [g/m$^2$] | Oil [g/m$^2$] |
| Reference example nr. | | | | | | | | | | |
| 1 | — | — | 3.73 | 13.45 | 45 | 24 | 5 | 3 | 0.175 | 0.033 |
| 2 | CPD06 | 15 | 3.73 | 13.45 | 45 | 24 | 5 | 3 | 0.175 | 0.033 |
| Comparative example nr. | | | | | | | | | | |
| 11 | — | — | 3.73 | 13.45 | 45 | 24 | 5 | 3 | 0.175 | 0.033 |
| Invention example nr. | | | | | | | | | | |
| 2 | TA01 | 15 | 3.73 | 13.45 | 45 | 24 | 5 | 3 | 0.175 | 0.033 |
| 3 | TA02 | 15 | 3.73 | 13.45 | 45 | 24 | 5 | 3 | 0.175 | 0.033 |
| 4 | TA03 | 15 | 3.73 | 13.45 | 45 | 24 | 5 | 3 | 0.175 | 0.033 |

The thermographic recording materials of COMPARATIVE EXAMPLE 11 and INVENTION EXAMPLES 2 to 4 were printed and the prints evaluated as described for REFERENCE EXAMPLES 1 to 3 and COMPARATIVE EXAMPLE 1. The results are given in Table 10 in which the results for REFERENCE EXAMPLES 1 and 2 are also included.

TABLE 10

| | | | Fresh prints | | | | | |
|---|---|---|---|---|---|---|---|---|
| | Toning agent | | | | CIELAB-values | | | |
| | | conc. [mol | Dmin | Dmax | At D = 1.0 | | At D = 2.0 | |
| | type | % vs AgB] | vis | vis | a* | b* | a* | b* |
| Reference example nr | | | | | | | | |
| 1 | — | — | 0.21 | 3.27 | +22.01 | +19.78 | +23.71 | +6.57 |
| 2 | CPD06 | 15 | 0.22 | 3.13 | +16.30 | +3.43 | +15.04 | −5.95 |
| Comparative example nr. | | | | | | | | |
| 11 | — | — | 0.21 | 3.53 | +18.42 | +8.96 | +16.40 | +5.14 |
| Invention Example nr | | | | | | | | |
| 2 | TA01 | 15 | 0.23 | 3.08 | +12.23 | −4.06 | +10.34 | −0.86 |
| 3 | TA02 | 15 | 0.21 | 2.97 | +9.44 | −7.96 | +8.60 | −3.54 |
| 4 | TA03 | 15 | 0.21 | 3.09 | +10.94 | −5.63 | +10.22 | −2.21 |

Considering the results of Table 2 and Table 10 together, which is permissible in view of the identical compositions of the thermographic recording materials other than the "toning agent" and the similar a* and b* CIELAB-values at D=1.0 and D=2.0 for REFERENCE EXAMPLE 1 and COMPARATIVE EXAMPLE 11, we find that TA01, TA02, and TA03, toning agents according to the present invention, exhibit strong toning properties in the thermosensitive elements of thermographic recording materials with a copolymer of vinyl aceto-acetal, vinyl butyral, vinyl alcohol and vinyl acetate as binder i.e. much more neutral a* CIELAB-values for D=1.0 and D=2.0 and much more blue i.e. negative b* CIELAB-values for D=1.0 and D=2.0 and moreover are surprisingly stronger than those exhibited by saccharin (CPD06) in the thermosensitive element of thermographic recording materials with a copolymer of vinyl aceto-acetal, vinyl butyral, vinyl alcohol and vinyl acetate as binder with respect to lower a* CIELAB-values at both D=1.0 and D=2.0 and more negative b* CIELAB-values at D=1.0 to which the human eye is more sensitive.

Reference Example 4, Comparative Examples 12 to 15 and Invention Examples 5 and 6

The substantially light-insensitive thermographic materials of REFERENCE EXAMPLE 4, COMPARATIVE EXAMPLES 12 to 15 and INVENTION EXAMPLES 5 and 6 were prepared as described for REFERENCE EXAMPLES 1 to 3 COMPARATIVE EXAMPLE 1, but with the compositions given in Table 11 below.

TABLE 11

| | toning agent | | AgBeh | | | R02 | S01 | S02 | S03 | | |
|---|---|---|---|---|---|---|---|---|---|---|---|
| | type | mol % vs AgB | coverage [g/m$^2$] | BL5HP [g/m$^2$] | COPOLYMER 01 [g/m$^2$] | mol % vs AgB | mol % vs AgB | mol % vs AgB | mol % vs AgB | VL [g/m$^2$] | Oil [g/m$^2$] |
| Reference example nr. | | | | | | | | | | | |
| 4 | CPD09 | 15 | 3.73 | 3.73 | 9.72 | 45 | 24 | 5 | 3 | 0.175 | 0.033 |
| Comparative example nr. | | | | | | | | | | | |
| 12 | — | — | 3.73 | 3.73 | 9.72 | 45 | 24 | 5 | 3 | 0.175 | 0.033 |
| 13 | CPD01 | 15 | 3.73 | 3.73 | 9.72 | 45 | 24 | 5 | 3 | 0.175 | 0.033 |
| 14 | CPD06 | 15 | 3.73 | 3.73 | 9.72 | 45 | 24 | 5 | 3 | 0.175 | 0.033 |
| 15 | CPD10 | 15 | 3.73 | 3.73 | 9.72 | 45 | 24 | 5 | 3 | 0.175 | 0.033 |
| Invention example nr. | | | | | | | | | | | |
| 5 | TA02 | 15 | 3.73 | 3.73 | 9.72 | 45 | 24 | 5 | 3 | 0.175 | 0.033 |
| 6 | TA03 | 15 | 3.73 | 3.73 | 9.72 | 45 | 24 | 5 | 3 | 0.175 | 0.033 |

The thermographic recording materials of REFERENCE EXAMPLE 4, COMPARATIVE EXAMPLES 12 to 15 and INVENTION EXAMPLES 5 and 6 were printed and the prints evaluated as described for REFERENCE EXAMPLES 1 to 3 and COMPARATIVE EXAMPLE 1. The results are given in Table 12.

TABLE 12

| | | | Fresh prints | | | | | |
|---|---|---|---|---|---|---|---|---|
| | Toning agent | | | | CIELAB-values | | | |
| | | | | | At D = 1.0 | | At D = 2.0 | |
| | type | conc. [mol % vs AgB] | Dmin vis | Dmax vis | a* | b* | a* | b* |
| Reference example nr. | | | | | | | | |
| 4 | CPD09 | 15 | 0.21 | 3.56 | +14.31 | −4.60 | +17.38 | −3.36 |
| Comparative example nr. | | | | | | | | |
| 12 | — | — | 0.21 | 3.56 | +16.60 | +7.77 | +18.04 | +2.17 |
| 13 | CPD01 | 15 | 0.21 | 3.12 | +12.63 | +3.45 | +13.68 | +6.54 |
| 14 | CPD06 | 15 | 0.22 | 3.06 | +11.65 | −0.54 | +11.94 | −1.06 |
| 15 | CPD10 | 15 | 0.21 | 2.87 | +11.88 | +0.83 | +14.43 | +1.59 |
| Invention Example nr. | | | | | | | | |
| 5 | TA02 | 15 | 0.21 | 2.83 | +8.87 | −4.26 | +10.75 | −1.59 |
| 6 | TA03 | 15 | 0.21 | 2.90 | +10.74 | −2.49 | +11.56 | −2.39 |

The results in Table 12 show that TA02 and TA03, both toning agents according to the present invention, exhibit strong toning properties in the thermosensitive element of thermographic recording materials with a mixture of a polyvinylbutyral and a copolymer of vinyl aceto-acetal, vinyl butyral, vinyl alcohol and vinyl acetate as binders i.e. much more neutral a* CIELAB-values for D=1.0 and D=2.0 and much more blue i.e. negative b* CIELAB-values for D=1.0 and D=2.0, whereas barbituric acid, CPD01, and 2-benzoxazinethiol, CPD10, both cited as toning agents in U.S. Pat. No. 3,080,254 exhibited very weak toning properties in the thermosensitive element of thermographic recording materials. Moreover, TA02 and TA03, both toning agents according to the present invention, surprisingly exhibited superior toning properties in the thermosensitive element of thermographic recording materials with a mixture of a polyvinylbutyral and a copolymer of vinyl aceto-acetal, vinyl butyral, vinyl alcohol and vinyl acetate as binders than saccharin, CPD06.

However, the toning effect of TA01, TA02 and TA03 is weaker in a thermosensitive element with a mixture of a polyvinylbutyral and a copolymer of vinyl aceto-acetal, vinyl butyral, vinyl alcohol and vinyl acetate as binders than with a copolymer of vinyl aceto-acetal, vinyl butyral, vinyl alcohol and vinyl acetate as binder.

Furthermore, although the toning effect of phthalazinone, CPD09, is marginally stronger in the thermosensitive element of thermographic recording materials with a mixture of a polyvinyl butyral and a copolymer of vinyl aceto-acetal, vinyl butyral, vinyl alcohol and vinyl acetate as binders than TA02 and TA03 in respect of the b* CIELAB-values attained at D=1.0 and D=2.0, it is much less strong than TA02 and TA03 in respect of the a* CIELAB-values attained at D=1.0 and D=2.0.

Comparative Example 16 and Invention Example 8

The substantially light-insensitive thermographic materials of COMPARATIVE EXAMPLE 16 and INVENTION EXAMPLE 8 were prepared as described for REFERENCE EXAMPLES 1 to 3 and COMPARATIVE EXAMPLE 1, but with the compositions given in Table 13 below.

TABLE 13

| | toning agent | | AgBeh ] | | R02 | S01 | S02 | S03 | | ] |
|---|---|---|---|---|---|---|---|---|---|---|
| zebra | type | mol % vs AgB | coverage [g/m$^2$ | COPOLYMER 01 [g/m$^2$] | mol % vs AgB | mol % vs AgB | mol % vs AgB | mol % vs AgB | VL [g/m$^2$] | Oil [g/m$^2$ |
| Comparative example nr. | | | | | | | | | | |
| 16 | — | — | 3.73 | 13.45 | 45 | 24 | 5 | 3 | 0.175 | 0.033 |
| Invention example nr. | | | | | | | | | | |
| 8 | TA04 | 15 | 3.73 | 13.45 | 45 | 24 | 5 | 3 | 0.175 | 0.033 |

The thermographic recording materials of COMPARATIVE EXAMPLE 16 and INVENTION EXAMPLE 8 were printed and the prints evaluated as described for REFERENCE EXAMPLES 1 to 3 and COMPARATIVE EXAMPLE 1. The results are given in Table 14.

TABLE 14

| | | | Fresh prints | | | | | |
|---|---|---|---|---|---|---|---|---|
| | Toning agent | | | | CIELAB-values | | | |
| | | conc. [mol | Dmin | Dmax | At D = 1.0 | | At D = 2.0 | |
| | type | % vs AgB] | vis | vis | a* | b* | a* | b* |
| Comparative Example nr | | | | | | | | |
| 16 | — | — | 0.21 | 3.39 | +16.98 | +10.72 | +16.24 | +4.64 |
| Invention Example nr | | | | | | | | |
| 8 | TA004 | 15 | 0.21 | 2.91 | +9.07 | −5.47 | +8.72 | −1.32 |

The results of Table 14 show that TA04, a toning agent according to the present invention, exhibits strong toning properties in the thermosensitive element of thermographic recording materials with a mixture of a polyvinylbutyral and a copolymer of vinyl aceto-acetal, vinyl butyral, vinyl alcohol and vinyl acetate as binders i.e. much more neutral a* CIELAB-values for D=1.0 and D=2.0 and much more blue i.e. negative b* CIELAB-values for D=1.0 and D=2.0.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermographic recording material comprising a support and a thermosensitive element, said thermosensitive element comprising a substantially light-insensitive organic silver salt, an organic reducing agent therefor in thermal working relationship therewith, a binder and at least one toning agent, wherein said at least one toning agent is represented by formula (I):

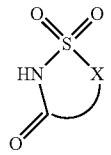

(I)

wherein X represents an optionally substituted —O—C═C— group with the oxygen atom directly bonded to the sulphur atom of the sulphonyl group.

2. The thermographic recording material according to claim 1, wherein said thermographic recording material is a black and white thermographic recording material.

3. The thermographic recording material according to claim 1, wherein said thermographic recording material is a monosheet thermographic recording material.

4. The thermographic recording material according to claim 1, wherein said thermosensitive element further comprises photosensitive silver halide.

5. The thermographic recording material according to claim 1, wherein said thermographic recording material is a substantially light-insensitive thermographic recording material.

6. A thermographic recording material comprising a support and a thermosensitive element, said thermosensitive element comprising a substantially light-insensitive organic silver salt, an organic reducing agent therefor in thermal working relationship therewith, a binder and at least one toning agent wherein said at least one toning agent is represented by formula (I):

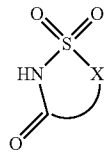

(I)

wherein X represents a —O—$R^1$C═C$R^2$— group with the oxygen atom directly bonded to the sulphur atom of the sulphonyl group and $R^1$ and $R^2$ are independently hydrogen, halogen or an optionally substituted alkyl, aryl, alkoxy, aryloxy, acyl or nitrile group; or $R^1$ and $R^2$ together represent the atoms necessary to form a alicyclic, aryl, heterocyclic or heteroaromatic ring system.

7. Thermographic recording material according to claim 6, wherein said thermographic recording material is a black and white thermographic recording material.

8. Thermographic recording material according to claim 6, wherein said thermographic recording material is a monosheet thermographic recording material.

9. Thermographic recording material according to claim 6, wherein said thermosensitive element further contains photosensitive silver halide.

10. Thermographic recording material according to claim 6, wherein said thermographic recording material is a substantially light-insensitive thermographic recording material.

11. A thermographic recording material comprising a support and a thermosensitive element, said thermosensitive element comprising a substantially light-insensitive organic silver salt, an organic reducing agent therefor in thermal working relationship therewith, a binder and at least one toning agent, wherein said at least one toning agent is represented by formula (I):

(I)

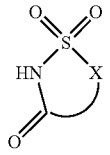

wherein X is

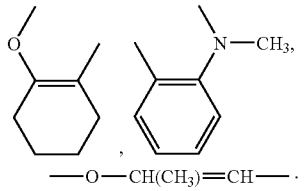

12. Thermographic recording material according to claim 11, wherein said thermographic recording material is a black and white thermographic recording material.

13. Thermographic recording material according to claim 11, wherein said thermographic recording material is a monosheet thermographic recording material.

14. Thermographic recording material according to claim 11, wherein said thermosensitive element further contains photosensitive silver halide.

15. Thermographic recording material according to claim 11, wherein said thermographic recording material is a substantially light-insensitive thermographic recording material.

16. A thermographic recording material comprising a support and a thermosensitive element, said thermosensitive element comprising a substantially light-insensitive organic silver salt, an organic reducing agent therefor in thermal working relationship therewith, a binder and at least one toning agent, wherein said at least one toning is selected from the group consisting of

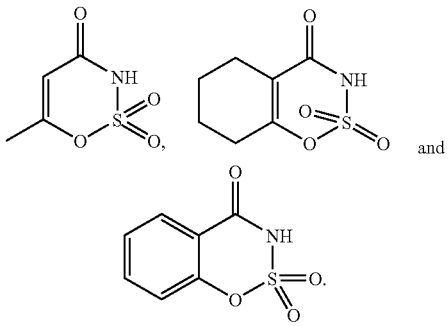

17. Thermographic recording martial according to claim 16, wherein said thermographic recording material is a black and white thermographic recording material.

18. Thermographic recording material according to claim 16, wherein said thermographic recording material is a monosheet thermographic recording material.

19. Thermographic recording material according to claim 16, wherein said thermosensitive element further contains photosensitive silver halide.

20. Thermographic recording material according to claim 16, wherein said thermographic recording material is a substantially light-insensitive thermographic recording material.

21. A process using compounds represented by formula (I):

(I)

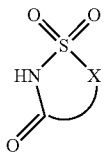

as toning agents in imaging processes involving the formation of silver particles comprising the steps of: providing a thermographic recording material: imagewise heating or imagewise exposure followed by uniform heating of said imagewise exposed thermographic recording material, wherein X represents a —O—$R^1$C═C$R^2$— group with the oxygen atom directly bonded to the sulphur atom of the sulphonyl group and $R^1$ and $R^2$ are independently hydrogen, halogen or an optionally substituted alkyl, aryl, alkoxy, aryloxy, acyl or nitrile group; or $R^1$ and $R^2$ together represent the atoms necessary to form a alicyclic, aryl, heterocyclic or heteroaromatic ring system.

22. A thermographic recording material comprising a support and a thermosensitive element, said thermosensitive element containing a substantially light-insensitive organic silver salt, an organic reducing agent therefor in thermal working relationship therewith, a binder and at least one toning agent, wherein said at least one toning agent is a substituted or unsubstituted 3,4-dihydro-1,2,3-oxathiaz-4-one 2,2-dioxide.

23. Thermographic recording material according to claim 22, wherein said thermographic recording material is a monosheet thermographic recording material.

24. Thermographic recording material according to claim 22, wherein said thermographic recording material is a black and white thermographic recording material.

25. Thermographic recording material according to claim 22, wherein said thermosensitive element further contains photosensitive silver halide.

26. Thermographic recording material according to claim 22, wherein said thermographic recording material is a substantially light-insensitive thermographic recording material.

* * * * *